US005918589A

United States Patent [19]

Valle et al.

[11] Patent Number: 5,918,589

[45] Date of Patent: Jul. 6, 1999

[54] LOW MOISTURE/CLOSED DOOR BROIL OVEN VENTILATION SYSTEM

[75] Inventors: Miguel A. Valle; Bobby Joe Jenkins, both of Oxford, Miss.; George A. Mikalauskas, Dayton; Gregory J. Paul, Englewood, both of Ohio

[73] Assignee: Whirlpool Corporation, Benton Harbor, Mich.

[21] Appl. No.: 08/797,475

[22] Filed: Feb. 6, 1997

Related U.S. Application Data

[60] Provisional application No. 60/017,370, May 10, 1996.

[51] Int. Cl.[6] ..... F23M 7/00

[52] U.S. Cl. ..... 126/193; 126/198; 126/77; 126/80; 126/21 A

[58] Field of Search ..... 126/193, 198, 126/21 R, 21 A, 80, 77, 512, 273 R, 190

[56] References Cited

U.S. PATENT DOCUMENTS

| | | | |
|---|---|---|---|
| 4,163,894 | 8/1979 | Scherer | 126/21 R |
| 4,207,863 | 6/1980 | Drouin | 126/198 |
| 4,331,124 | 5/1982 | Seidel et al. | 126/21 A |
| 4,353,351 | 10/1982 | Cagle | 126/193 |
| 4,527,542 | 7/1985 | Bales et al. | 126/21 R |
| 4,547,642 | 10/1985 | Smith | 126/21 A |
| 4,549,055 | 10/1985 | Kohler | 126/21 R |
| 4,892,030 | 1/1990 | Grieve | 126/21 A |
| 4,954,693 | 9/1990 | Mitsuhashi et al. | 126/21 A |
| 5,387,258 | 2/1995 | Puricelli | 126/21 R |

*Primary Examiner*—Ira S. Lazarus
*Assistant Examiner*—Josiah C. Cocks
*Attorney, Agent, or Firm*—Hill & Simpson

[57] ABSTRACT

An oven having a ventilation system capable of providing reduced temperature, low moisture exhaust air is provided. The oven has an oven cavity defined by a partition having a through hole and enclosed by an oven door having an air inlet to accept incoming air and a separator located within the door to divide the incoming air into at least a first path and a second path. The oven has an air duct surrounding the partition having at least one inlet at the front of the oven below the door, at least one inlet at the back of the oven and an air outlet at the front of the oven above the door. Also, the oven has a ventilation system capable of providing reduced temperature exhaust air out the air outlet located at the front of the oven. The ventilation system includes a vent box having a vent cap located thereon, the vent cap having at least one opening; a vent tube constructed and arranged in the through hole of the partition connecting the oven cavity to the vent box to allow oven air from the oven cavity to pass to the vent box; and a device for generating a supply of forced air from air drawn in through the air inlets via the air duct. The device for generating a supply of forced air is constructed and arranged such that the supply of forced air travels through the opening of the vent cap thereby creating suction to combine the forced air with the oven air from the vent tube to form a combined airflow. The combined airflow is exhausted out the air outlet at the front of the oven above the door.

16 Claims, 3 Drawing Sheets

H
26
H
22
20
D
12
66
C
18
64
60
74
36
90
84
46
16
F
G
96
76
G
34
32
E
70
A
72
42
48
44
100
50
56
40
B
B
A
54
62
62

FIG. 4
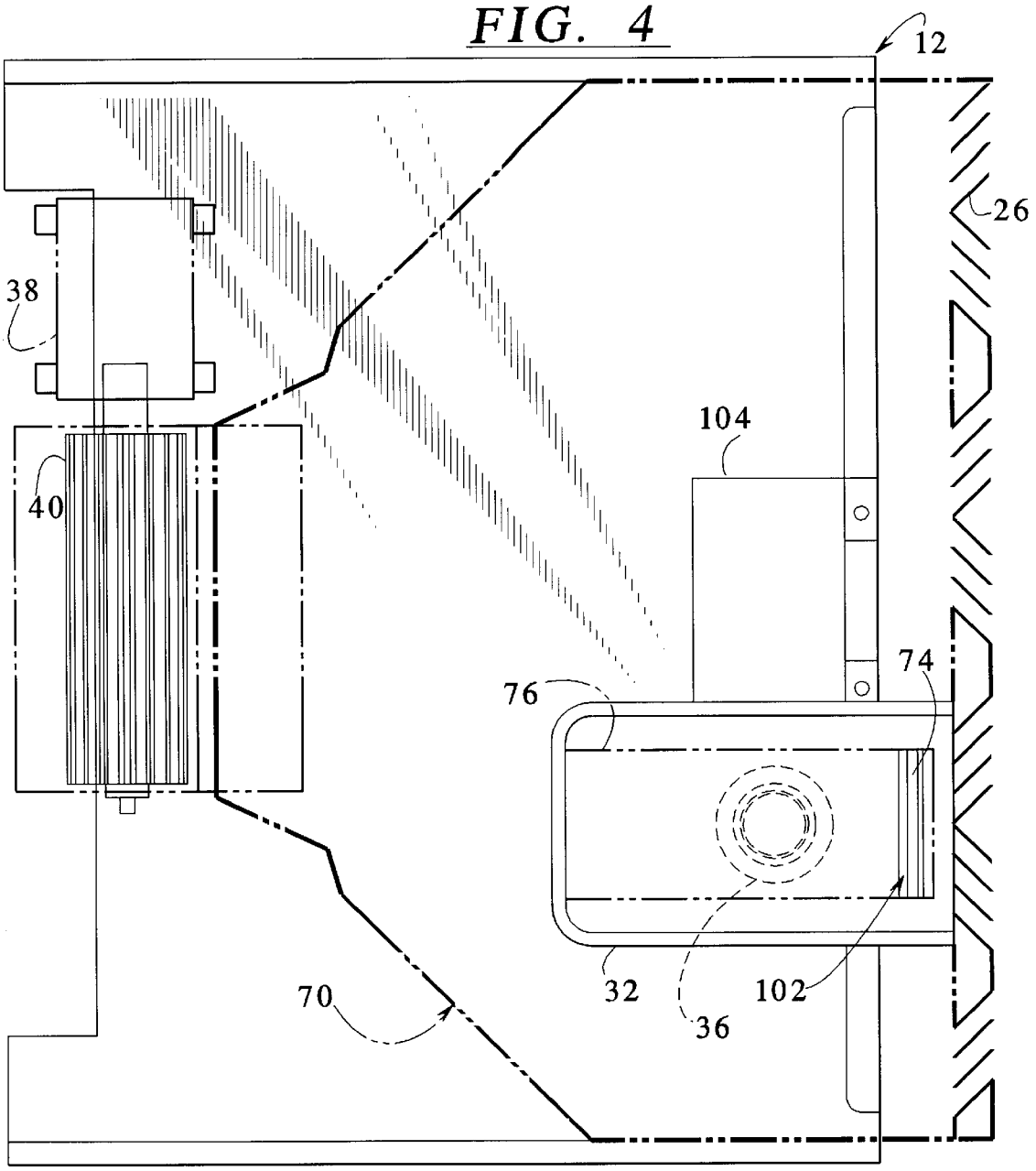
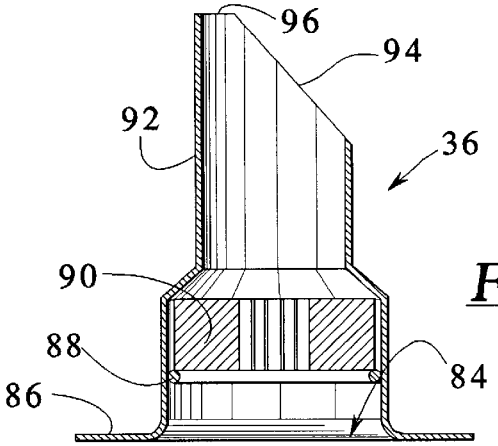
FIG. 3

LOW MOISTURE/CLOSED DOOR BROIL OVEN VENTILATION SYSTEM

This application claims the benefit of U.S. Provisional Application(s) No(s).: 60/017,370 filed May 10, 1996.

BACKGROUND OF THE INVENTION

The present invention relates generally to an oven and more particularly to a low moisture/closed door broil oven ventilation system.

Known oven designs include single ovens, double ovens and combination ovens that have a conventional oven and a microwave oven. Of course, the ovens may be used for roasting certain items including turkeys, chickens or other high moisture foods. The hot, moist air generated during the roasting of such foods must be dissipated by some sort of ventilation system. Ventilation systems are provided in most ovens for venting some hot air from the oven and to remove moisture when cooking such a high moisture load. However, it is unacceptable to have a large amount of the moisture vented out of the oven because of condensation that could occur on the front of the oven or on the cabinetry surrounding the oven.

In addition, most ovens have a broiler. The broilers are typically used for cooking such items as steaks and other meats at high temperatures. However, when cooking a steak or the like in the broiler, a large amount of smoke can develop because of the fat in the steak and the high temperatures at which the meat is being cooked. It is obviously undesirable for the ventilation or exhaust system of the oven to pump smoke out of the oven and into the kitchen. Thus, a ventilation system for an oven needs to meet certain design and performance requirements such as those that follow.

There are two key items involved in the evacuation of air from an oven. The first is the volumetric exit velocity of the air from the oven cavity. If the air is evacuated too quickly from the oven cavity, this can negatively affect the cooking performance and the oven preheat time. If the evacuation of the air is too slow, then after the completion of a closed door broil, when the user opens the door of the oven, a large unacceptable smoke cloud could pour forth from the oven and enter the kitchen. Thus, a ventilation system must be designed to handle the dissipation of the smoke cloud to prevent the kitchen from being polluted with smoky air.

The second key item in the design of an oven ventilation system is the exhaust air temperature. If the temperature of the exhaust air is too hot then there is a potential of burning the user or damaging kitchen cabinets that surround the oven. Also, an exhaust temperature that is too high may have a negative impact on the efficiency of the oven. For example, this condition would draw off too much heat that should be used for cooking. Also, if the exhaust air temperature is too low, then there is a condensation of the cooking by-products and steam as the exhaust exits the oven. This situation can cause damage to surrounding cabinets and possibly violate certain Underwriter's Laboratory or other safety requirements.

Several attempts have been made to combat the problems of oven ventilation systems and provide better ventilation for an oven. For example, U.S. Pat. No. 4,601,279 discloses an oven with a venting system for cooling oven controls. In FIG. 4, a vertical opening 31 exhausts air from the oven cavity into a passage exhausting cooling air. In addition, a catalytic cartridge 32 is provided. The vent system discharges through vents across the entire front of the oven after cooling air has mixed with hot air from the oven. Thus, this configuration provides a low moisture, low speed air exhaust from the oven.

Also, U.S. Pat. No. 4,654,508 discloses an electronic oven having an oven vent and catalyst reactor 11 exhausting into a cooling duct 10 so that air is mixed prior to exiting the oven cabinet. Also, a deflector and a baffle 18 are arranged in the air flow to help pull and mix air from the oven cavity.

Further, U.S. Pat. No. 4,331,124 discloses a built-in oven having an oven vent tube 48 exhausting air into a cooling air chamber 54 to be mixed therein prior to exhausting from the oven cabinet.

Thus, a need has arisen for a ventilation system that is cost effective, easily manufactured and provides the proper balance of exhaust temperature with the proper exit air velocity to achieve low moisture exhaust and optimum closed door broiling performance from an oven.

SUMMARY OF THE INVENTION

It is an object, therefore, to provide a low moisture/closed door broil oven ventilation system that properly balances the exhaust temperature with an exit air velocity to achieve low moisture exhaust and optimum closed door broiling performance in a cost effective manner.

To this end, in an embodiment, the present invention provides an oven having an oven cavity defined by a partition having a through hole. The oven cavity is enclosed by an oven door having an air inlet to accept incoming air. Within the door is a separator for dividing the incoming air into at least a first path and a second path. An air duct surrounds the partition and has at least one inlet at the front of the oven below the door, at least one inlet at the back of the oven and an air outlet at the front of the oven above the door. The oven also has a ventilation system capable of mixing forced air with oven air and exhausting the combined air out the air outlet located at the front of the oven. The ventilation system includes: a vent box having a vent cap located thereon, the vent cap having at least one opening, a vent tube constructed and arranged in the through hole of the partition connecting the oven cavity to the vent box to allow oven air from the oven cavity to pass to the vent box; and means for generating a supply of forced air from air drawn in through the air inlets via the air duct. The means for generating a supply of forced air is constructed and arranged such that the supply of forced air travels through the opening of the vent cap and over the vent tube thereby creating suction to draw the oven air from the oven cavity. The forced air combines with the oven air to form a combined airflow. The combined airflow is exhausted out the air outlet at the front of the oven above the door.

An advantage of the present invention is to provide an oven ventilation system that provides low moisture exhaust air from an oven when cooking high moisture foods therein.

Another advantage of the present invention is to provide a ventilation system for a closed door broil for an oven that reduces or eliminates smoke particles in the exhaust air by directing oven air through a catalyst.

A further advantage of the present invention is to provide an oven ventilation system having a high velocity air supply from a blower capable of drawing hot, moist air from the oven cavity and combining the cooler, dryer blower air therewith to produce a reduced temperature and reduced moisture exhaust air stream.

Yet another advantage of the present invention to provide a sensor to recognize a stoppage of airflow to thereby to turn the oven off for safe operation of the oven.

BRIEF DESCRIPTION OF THE DRAWINGS

FIG. 3 illustrates a cross sectional side view of an embodiment of a vent tube utilized in the low moisture/closed door broil oven ventilation system of the present invention.

FIG. 4 illustrates a plan view of an oven incorporating the low moisture/closed door broil oven ventilation system of the present invention.

DETAILED DESCRIPTION OF THE PREFERRED EMBODIMENTS

Figure 1:
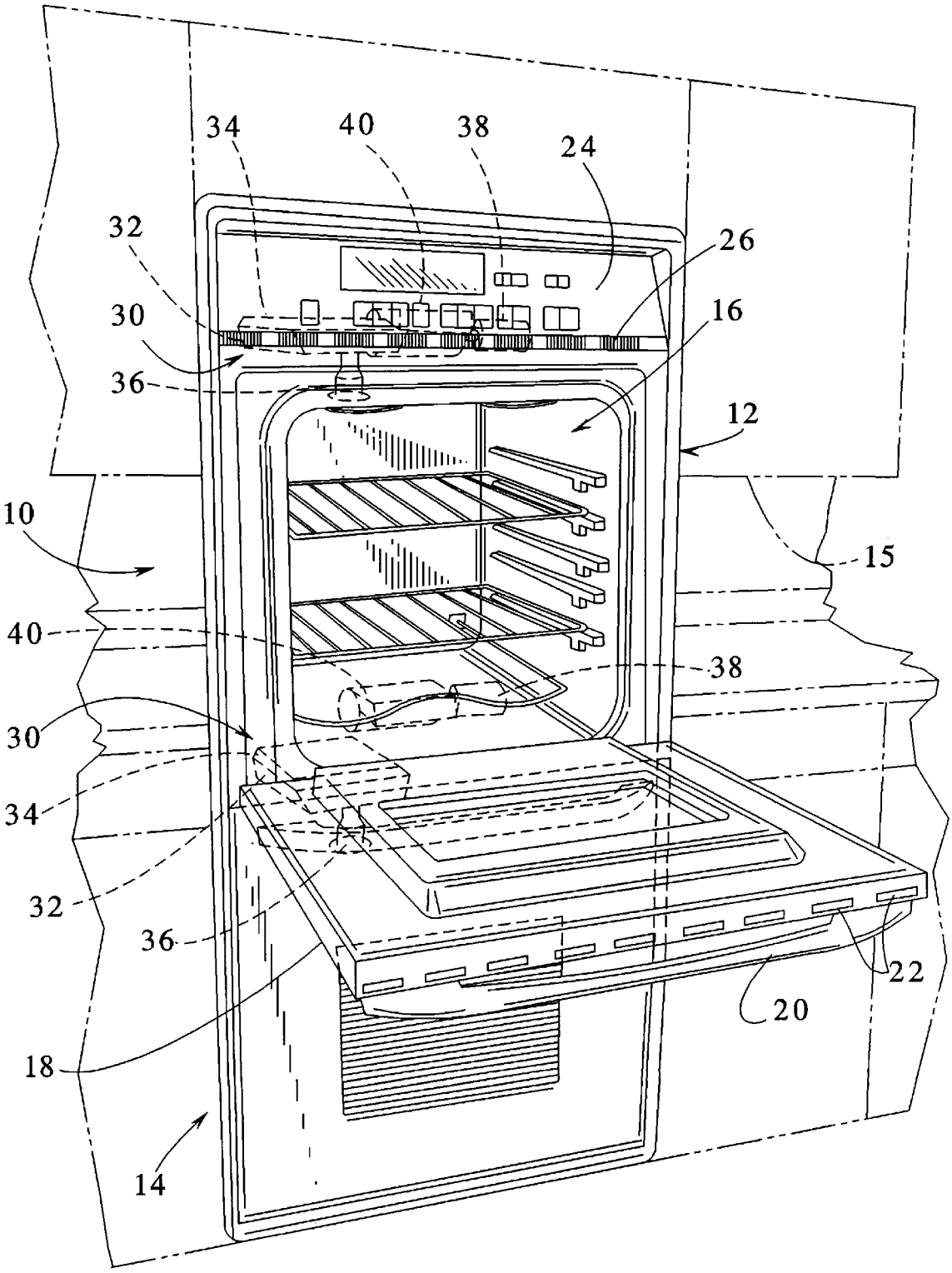
FIG. 1 illustrates a double oven in which the low moisture/closed door broil oven ventilation system of the present invention may be utilized.

FIG. 1 illustrates a double oven arrangement 10 having an upper oven 12 and a lower oven 14. The double oven 10 is mounted within cabinets 15. Each oven 12, 14 has an oven cavity 16 in which items to be cooked or baked are inserted. The upper oven 12 also has an oven door 18 shown in an open position in FIG. 1. The oven door 18 has a handle 20 and a plurality of slot vents 22 located at the top of the oven door 18 near the handle 20. The upper oven 12 also includes a control panel 24 for operating the upper oven 12 and the lower oven 14. Between the control panel 24 and the upper oven 12 is a row of vents 26. An embodiment of a low moisture/closed door broil oven ventilation system 30 is illustrated in dashed lines operatively arranged above both the upper oven 12 and above the lower oven 14. The ventilation system 30 includes a vent box 32, a vent box lid 34 and a vent tube 36. In addition, a motor 38 is provided which supplies power to a fan 40 that is used in the ventilation system 30. A discussion of the ventilation system 30 is found below with reference to FIGS. 2, 3 and 4.

Figure 2:
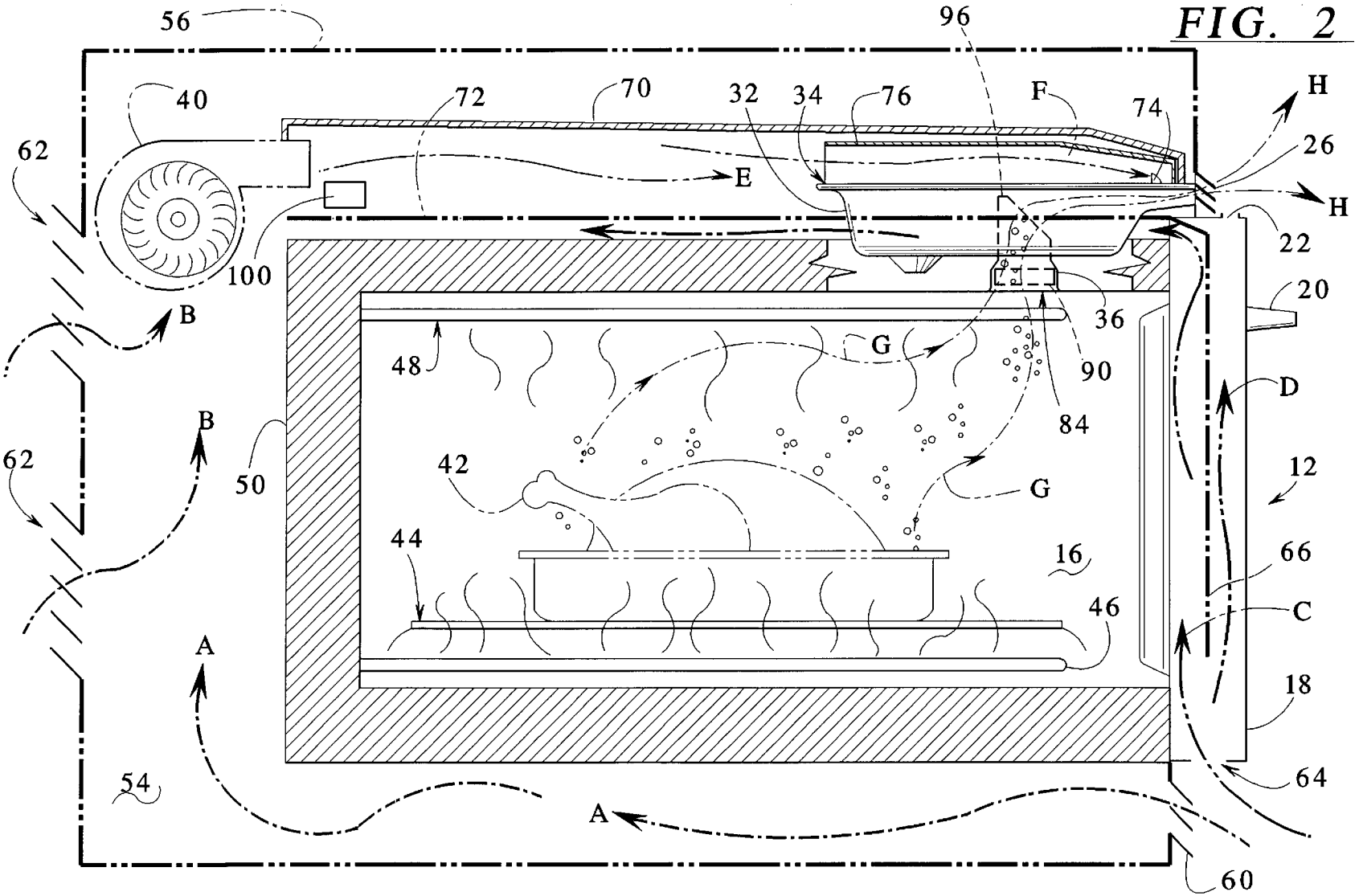
FIG. 2 illustrates a cut-away side view of an oven incorporating the low moisture/closed door broil oven ventilation system of the present invention.

FIG. 2 illustrates a cross-sectional side view of an oven utilizing the ventilation system 30 of the present invention. A turkey 42 is shown roasting in the oven cavity 16 of the oven 12. The turkey 42 rests on an oven rack 44 above a heating element 46. Also, a broiler element 48 is provided for broiling steaks and other meats. A heat-insulating partition 50 surrounds the oven cavity 16. An airflow pathway 54 is defined by the partition 50 and an oven enclosure 56 that encircles the partition 50 and the oven cavity 16. Front lower louvers 60 are located below the oven door 18 at the front of the oven 12. Thus, air can enter the front lower louvers 60 and travel through the airflow pathway 54 below the oven cavity 16 and up the back of the oven 12. This supply of air can be used for the fan 40. In addition, rear louvers 62 are provided at the back of the oven enclosure 56. Airflow indicated by arrows A is the air entering through the front lower louvers 60 and airflow indicated by arrows B is airflow from the rear louvers 62. Both the A and B airflows are provided to the fan 40.

In addition, the oven door 18 has an opening or a series of openings 64 at the bottom thereof for allowing air to enter the door 18. A door partition 66 splits the incoming air so that the inner air goes through the oven door 18 near the oven cavity 16. This air is represented by arrow C. A portion of the airflow represented by arrow D travels on the front side of the partition 66 and exits the door 18 through a plurality of slots 22 at the top of the oven door 18. Such a directing of the airflow helps to keep the exterior of the oven door 18 cooler. The portion of the airflow represented by arrows C travels around the partition 50, above the oven cavity 16 and back to the fan 40. The fan 40 then generates a controlled, forced airflow represented by arrow E. Airflow E is directed into an oven scoop 70 which is above an oven partition 72. A portion of the airflow E travels over the vent lid 34. This portion of airflow is represented by arrow F. In an embodiment, a single louver 74 is provided on the vent lid 34 to direct the airflow into the vent box 32. The louver 74 is arranged perpendicular to the direction of the airflow F (see FIG. 4). Thus, the fan air indicated by arrow E enters the vent box 32 via the louver 74 in the vent lid 34. A vent cap 76 is also provided to direct airflow. The vent cap 76 is described further below with reference to FIG. 4.

In addition, the vent tube 36 provides a conduit for moist air from the oven cavity 16 to pass into the vent box 32 as indicated by arrows G. The higher velocity air supplied by the fan 40 is indicated by arrow F. This supply of air combines with the oven exhaust air indicated by arrow G in the vent box 32. The high velocity air indicated by arrow F has a lower pressure than the low velocity exhaust air G coming from the oven cavity 16. This pressure differential causes the proper level of evacuation of the oven cavity 16. The combined airflow H thus has a relatively low temperature, moisture content and velocity than the oven cavity air indicated by the individual component airflow of arrow G. The vent tube 36 extends from the oven cavity 16 into the vent box 32. The airflow H subsequently travels out the row of vents 26 on the front of the oven 12.

The vent tube 36 is shown in cross-sectional detail in FIG. 3. As illustrated, the vent tube 36 has an inlet portion 84 with a flange 86 that is secured to the inside of the oven cavity 18. A seal 88 is provided to secure a catalyst 90 within the vent tube 36. The catalyst 90 is provided to facilitate a chemical reaction therein to minimize smoke particles. The catalyst 90 operates similarly to that of a catalytic converter of an automobile by using heat to operate. A tube portion 92 of the vent tube 36 extends above the catalyst 90 and has a 45° angled top edge 94. Thus, a slot portion 96 is provided. The forced air from the fan 40 passes over the slot portion 96 at the top of the vent tube 36 to draw the oven air up through the vent tube 36.

In this manner, the high velocity air supplied by the blower fan 40 through the vent channel helps pull the hot, moist air from the oven cavity 16, and the air from the fan 40 is exhausted through the vents 26 below the control panel 24 on the front of the oven 12. In addition, a sensor 100 is provided to turn off the oven in the event of a loss of airflow. The sensor 100 senses if the fan 40 is blowing air. If a lack of air movement is sensed, indicating the fan 40 has ceased operation, the oven 12 is shut off. For example, the sensor 100 may be a therm-o-disc (TOD) that senses temperature. When the sensor 100 senses a temperature above a preselected value, power is interrupted to the heating element 46 or the broiler element 48.

FIG. 4 illustrates a plan view of the oven 12 incorporating the low moisture/closed door broiler oven ventilation system of the present invention. As shown, the oven scoop 70 has approximately the width of the fan 40 near the fan and broadens out to have the approximate width of the oven 12 at the front thereof. The oven scoop 70 is thus in communication with the row of vents 26 at the front of the oven 12. The forced air generated by the fan 40 is exhausted out the entire width of the row of vents 26. Also, the combined air from within the vent box 32 is exhausted out the row of vents 26 as shown in FIG. 2.

FIG. 4 also shows the approximate arrangement of the vent box 32 and vent tube 36 with respect to the rest of the oven 12. The louver 74 described above is located near an opening 102 that is formed for allowing air to enter the vent box 32. The louver 74 acts to deflect the air from the fan 40 down into the opening 102. The deflected air from the fan 40 combines therein with the oven air. Also schematically illustrated is the latching mechanism 104 for the oven door. The vent cap 76 fits over the vent box 32 and helps to direct the forced air from the fan 40 into the louver 74 and opening 102.

It should be understood that we wish to embody within the scope of the patent warranted hereon, all such modifications as reasonably and properly fall within the scope of our contribution to the art.

The embodiments of the invention in which an exclusive property or privilege is claimed are therefore defined as follows:

1. An oven having a front and a back, the oven comprising:

an oven cavity defined by a partition having a through hole and enclosed by an oven door having a bottom and a top, the bottom of the door having a door air inlet to accept incoming air, the door further including a separator located within the door to divide the incoming air passing through the air inlet into at least a first path and a second path, the second path being disposed between the first path and the oven cavity, air flowing through the first path cooling an exterior surface of the door, the first path extending from the air inlet to a door air outlet disposed at the top of the door, the second path extending from the door air inlet, through the door to a top oven inlet disposed above the oven cavity, a first air duct surrounding the partition having at least one bottom inlet at the front of the oven below the door, at least one rear inlet at the back of the oven and an air outlet at the front of the oven above the door;

a second air duct connecting the top oven inlet to the first air duct; and a ventilation system including:

a vent box disposed in the first air duct and having a vent cap located thereon, the vent cap having at least one opening disposed opposite to and in a spaced relationship with a fan;

a vent tube constructed and arranged in the through hole of the partition connecting the oven cavity to the vent box to allow oven air from the oven cavity to pass to the vent box; and the fan disposed in the first air duct, the fan for generating a supply of forced air from air drawn in through the top, bottom and rear inlets via the air duct, the fans for generating a supply of forced air constructed and arranged such that a portion of the supply of forced air travels through the opening of the vent cap and over the vent tube to create suction so that the oven air is drawn by the suction through the vent tube and combines with the forced air thereby forming a combined airflow, the combined airflow exhausting out the air inlet at the front of the oven above the door.

2. The oven of claim 1, wherein the vent tube further comprises a catalyst to clean the oven air prior to exhausting same.

3. The oven of claim 1, wherein the vent tube further comprises:

a straight tube portion with a top edge portion at a 45° angle relative to the straight tube portion.

4. The oven of claim 1, wherein the air outlet at the front of the oven above the door extends across the width of the oven.

5. The oven of claim 1, further comprising:

an oven scoop having a first end adjacent the fan, the oven scoop having sidewalls extending to a second end at the front of the oven.

6. The oven of claim 1 wherein the at least one opening in the vent cap comprises a louver arranged perpendicular to a flow direction of the supply of forced air to direct a portion of the supply of forced air into the vent box.

7. The oven of claim 1, wherein the vent tube is arranged in the through hole of the partition connecting the oven cavity to the vent box such that the supply of forced air travels over the vent tube to create suction thereby drawing oven air from the oven cavity into the vent box.

8. The oven of claim 1, further comprising:

a detector for sensing fan stoppage by detecting an increase in temperature, the detector turning off the oven in the case of fan stoppage, the detector being located in the first air duct between the fan and the vent box.

9. An oven ventilation system comprising:

an oven having a front and a back including at least one air intake located in each of the front and the back of the oven and an air exhaust vent at the front of the oven;

a fan for generating an airflow;

a vent box having a vent cap located thereon for extracting air from an oven cavity, the vent box operatively connected to the fan, the vent cap having an outlet aperture and at least one opening positioned for receiving airflow from the fan, a vent tube connecting the oven cavity to the vent box to allow oven air from the oven cavity to pass to the vent box, and wherein the fan is constructed and arranged such that the airflow travels through the opening of the vent cap and over the vent tube thereby creating suction to draw air from the oven cavity through the vent tube into the vent box to combine with the air flow therein to form a combined airflow, the combined airflow exhausting out the air exhaust vent at the front of the oven; and the vent box and the fan combining the air from the oven cavity with the airflow to produce a combined airflow having a temperature and moisture content less than a temperature of the air from the oven cavity to exhaust said combined airflow from the air exhaust vent at the front of the oven.

10. The oven ventilation system of claim 9, wherein the vent tube further comprises a catalyst arranged to clean the air from the oven cavity prior to exhausting same.

11. The oven ventilation system of claim 9, further comprising:

a detector of sensing fan stoppage, the detector for turning off the oven by detecting an increase in temperature, the detector being located between the fan and the vent box.

12. The oven ventilation system of claim 9, wherein the vent means further comprises:

a vent tube having a straight tube portion with top edge portion at a 45° angle relative to the straight tube portion.

13. The oven ventilation system of claim 9, wherein the means for combining the air from the oven cavity with the airflow further comprises:

a vent box having an outlet aperture; and a vent cap having at least one opening mounted on the vent box, wherein the means for generating an airflow connects to the vent box such that the airflow enters the at least one opening in the vent cap and the vent means for extracting air from the oven cavity connects to the outlet aperture of the vent box.

14. The oven ventilation system of claim 9, further comprising:

an air duct circumscribing the oven cavity, the air duct connected to the at least one intake in the front and in the back of the oven and the air exhaust vent at the front of the oven.

15. The oven ventilation system of claim 14, wherein the air exhaust vent is located at the front of the oven above the oven cavity.

16. The oven ventilation system of claim 14, wherein the air exhaust vent is approximately equal to the width of the oven cavity.

* * * * *